US005542592A

United States Patent [19]

Hoffa et al.

[11] Patent Number: 5,542,592

[45] **Date of Patent: * Aug. 6, 1996**

[54] CABLE AND WIRE PRE-FEED APPARATUS

[75] Inventors: Jack L. Hoffa, Brea; Lloyd A. Talley, Valinda, both of Calif.

[73] Assignee: Eubanks Engineering Company, Monrovia, Calif.

[ * ] Notice: The term of this patent shall not extend beyond the expiration date of Pat. No. 5,366,131.

[21] Appl. No.: 344,587

[22] Filed: Nov. 18, 1994

Related U.S. Application Data

[63] Continuation of Ser. No. 16,296, Feb. 11, 1993, Pat. No. 5,366,131, which is a continuation-in-part of Ser. No. 792, 634, Nov. 15, 1991, abandoned.

[51] Int. Cl.[6] ..... B65H 59/38; B65H 51/30

[52] U.S. Cl. ..... 226/118; 226/44; 226/170; 226/190

[58] Field of Search ..... 226/44, 118, 189, 226/170, 190, 168, 119; 242/45

[56] References Cited

U.S. PATENT DOCUMENTS

| | | |
|---|---|---|
| 3,049,308 | 8/1962 | Lang . |
| 3,051,362 | 8/1962 | Shook . |
| 3,278,100 | 10/1966 | Hornberger . |
| 3,380,678 | 4/1968 | Feasey et al. . |
| 3,841,545 | 10/1974 | Gingher, Jr. . |
| 4,058,265 | 11/1977 | Hedlund et al. . |
| 4,186,861 | 2/1980 | Steinhilber . |
| 4,196,252 | 4/1980 | Sawyer et al. . |
| 4,215,827 | 8/1980 | Roberts et al. . |
| 4,793,564 | 12/1988 | Hank et al. . |
| 5,115,007 | 5/1992 | Chihara et al. . |
| 5,139,206 | 8/1992 | Butler . |

FOREIGN PATENT DOCUMENTS

| | | |
|---|---|---|
| 287802 | 12/1988 | European Pat. Off. . |
| 2618422 | 1/1989 | France . |
| 59833 | 1/1982 | Germany . |
| 3116713 | 11/1982 | Germany . |
| 54-118584 | 8/1979 | Japan . |
| 930347 | 1/1961 | United Kingdom . |

OTHER PUBLICATIONS

"Accessories for Eubanks Automatic Wire Strippers", Eubanks Engineering Company, 1990.

"Optional Equipment for Artos Wire Processing Machinery", Artos, Artos Engineering Company, Bulletin No. A 15–1. No Date Supplied.

"Komax Cable Pre–Feeding and Stacking Systems", Komax Corporation, 1984.

*Primary Examiner*—Andy Falik

*Attorney, Agent, or Firm*—William W. Haefliger

[57] ABSTRACT

A wire feeding system, for use with apparatus that processes the wire in conjunction with intermittent advancement of the wire, the feeding system operating to de-reel the wire from a reel and supply the de-reeled wire to the apparatus, the system comprising wire drive structure to positively advance the wire; lost motion structure between the wire drive structure and the wire processing apparatus to maintain the wire taut during intermittent operation of the wire processing apparatus; and the wire drive structure comprising belt loop structure having elongated wire gripping stretch structure. Adjustability of the belt loops is also provided, along with use of associated wire guide means for wires of different diameters.

15 Claims, 8 Drawing Sheets

73
76
5
20
to 15
23
17
72
FROM 11
71
16
10
25
30
21
74
27
77
5

76
73
20b
20c
23
20a
20
71
72
18
40
25
38
10
32
37
74
21b
21c
21a
21
28
27
77

FIG. 9.
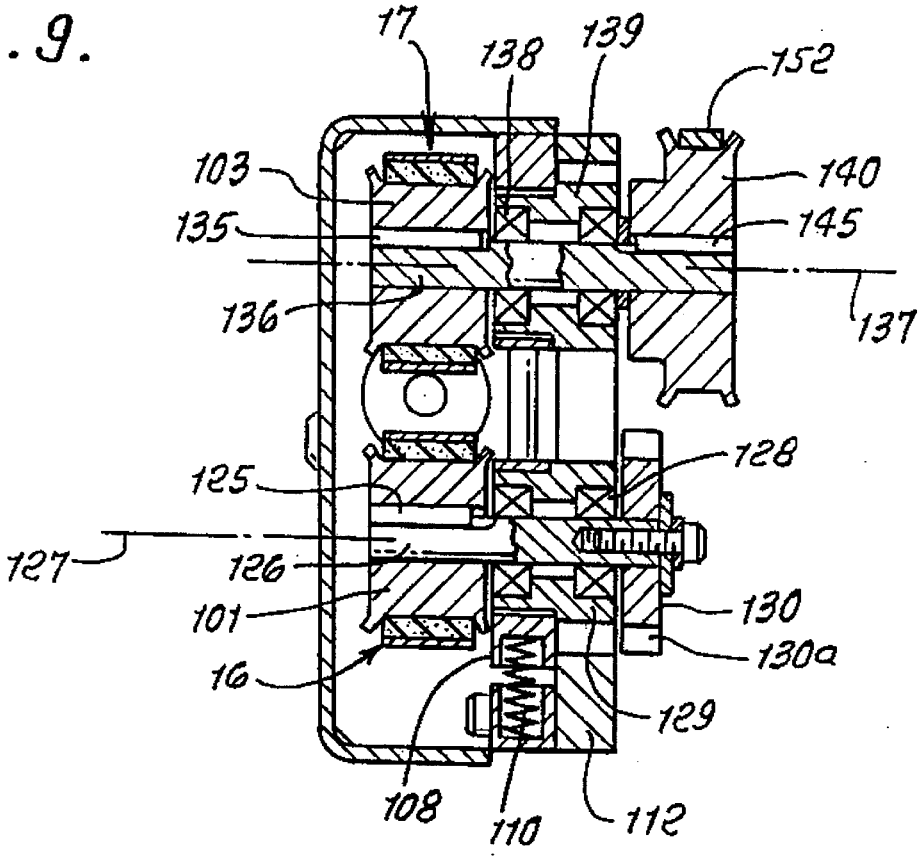
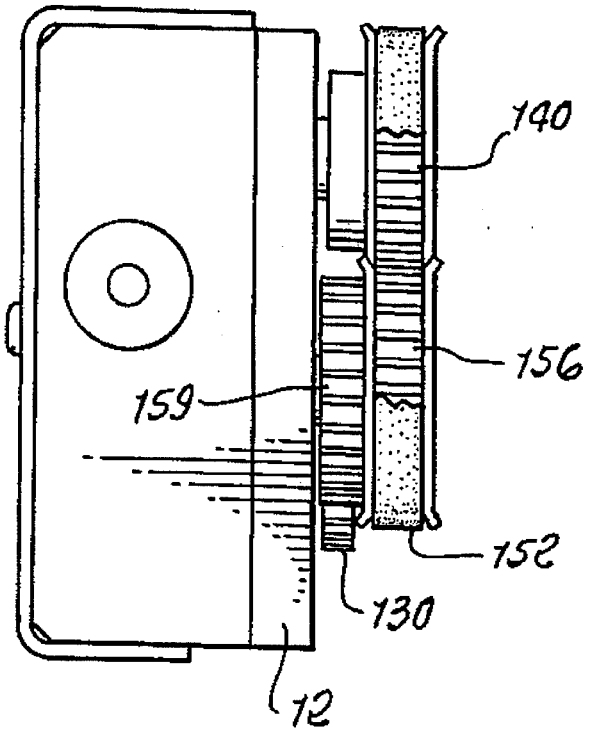
FIG. 10.

CABLE AND WIRE PRE-FEED APPARATUS

BACKGROUND OF THE INVENTION

This is a continuation of application Ser. No. 08/016,296 filed Feb. 11, 1993, U.S. Pat. No. 5,366,131 which is a continuation-in-part of Ser. No. 07/792,634 filed Nov. 15, 1991, now abandoned.

This invention relates generally to the feeding of cable or wire to processing means, such as a cutter or insulation stripper; and more particularly concerns apparatus for feeding the cable or wire from a de-reeling means to a wire or cable feed mechanism which operates intermittently.

In apparatus, as referred to, there is a problem of converting supply wire de-reeling travel from a first velocity or velocities upon de-reeling from a supply reel, to an intermittent feed velocity as the wire is fed to processing means. The latter operates intermittently, for example, due to the fact that the wire travel must be stopped while the wire is cut or stripped (of insulation). There is need for accurately and reliably driving the wire intermittently, as referred to, for such purposes.

There is also need for an improved wire drive means to be incorporated in such apparatus, and characterized as positively gripping and driving the wire endwise, while the wire is compressively gripped lengthwise thereof.

SUMMARY OF THE INVENTION

It is a major object of the present invention to provide a solution to the above problems and difficulties.

The improved system of the present invention basically comprises:

a) wire drive means to positively advance the wire, b) lost motion means between the wire drive means and the wire supply reel to maintain the wire taut during intermittent operation of the drive means, and c) the wire drive means comprising belt means having elongated wire gripping stretch means.

As will be seen, the belt means may advantageously comprise two endless belt loops, the stretch means comprising two elongated belt stretches between which the wire is gripped as it is driven endwise. Such belts may comprise timing belts; and spring means may be provided to urge at least one of the belts toward the other to compressively engage the wire between the stretches. The wire drive means may also include a motor connected in driving relation with the belts to advance the stretches in a generally linear direction.

Another object is to provide the wire drive means with first timing rotors on which the endless belts are entrained, additional timing rollers connected with certain of the first rollers, and additional timing belt means driven by the motor and connected with the additional timing rollers.

Other objects are to provide for adjustability of the belts toward and away from one another while accommodated to timing belt drive of the belts; and while accommodated to wire guides associated with the belt loops.

Yet another object is to include apparatus, as follows:

a) a first endless element and a second endless element, and means mounting these elements so that the second element is movable relatively toward and away from the first element, b) first means for urging the second element away from the first element, c) wire drive means to positively advance the wire toward the apparatus, d) and the wire successively passing between the elements, in passing from the supply reel to the drive means, e) whereby the wire is maintained taut as the second element moves toward and away from the first element in response to intermittent operation of the drive means, f) and second means for controlling the speed of the drive means in response to sensing of the position of the second element, g) the wire drive means comprising belt means having elongated wire gripping stretch means.

As will be seen the elements may comprise pulleys which are spaced from the wire drive belt means; and there may be one or more first element pulleys, and one or more second element pulleys.

Additional objects include the provision, in the above improved system, of a follower block mounting the second element. In this regard, the second means for controlling speed of the drive may comprise a sensor to sense position of the follower block along a vertical rod, and a control is operatively connected to the sensor to electrically control the speed of the drive means, whereby the speed is decreased in response to lowering the block, and increased in response to rising raising the block.

Yet another object is to provide a vertical guide and a follower means carrying the second element, the follower means slidable up and down on the guide, and wherein a weight is provided at one axial side of the second element, and the follower means is at the opposite axial side of the second element, for balance during element up and down movement.

These and other objects and advantages of the invention, as well as the details of an illustrative embodiment, will be more fully understood from the following specification and drawings, in which:

DRAWING DESCRIPTION

FIG. 9 is a section taken on lines 9—9 of FIG. 7;

FIG. 10 is an end view taken on lines 10—10 of FIG. 7;

DETAILED DESCRIPTION

Figure 1:
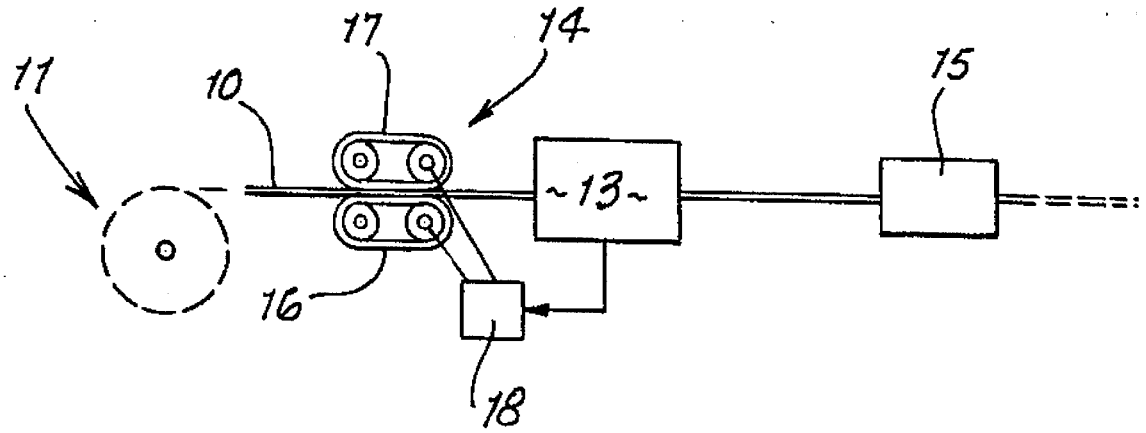
FIG. 1 is a schematic diagram.
Figure 2:
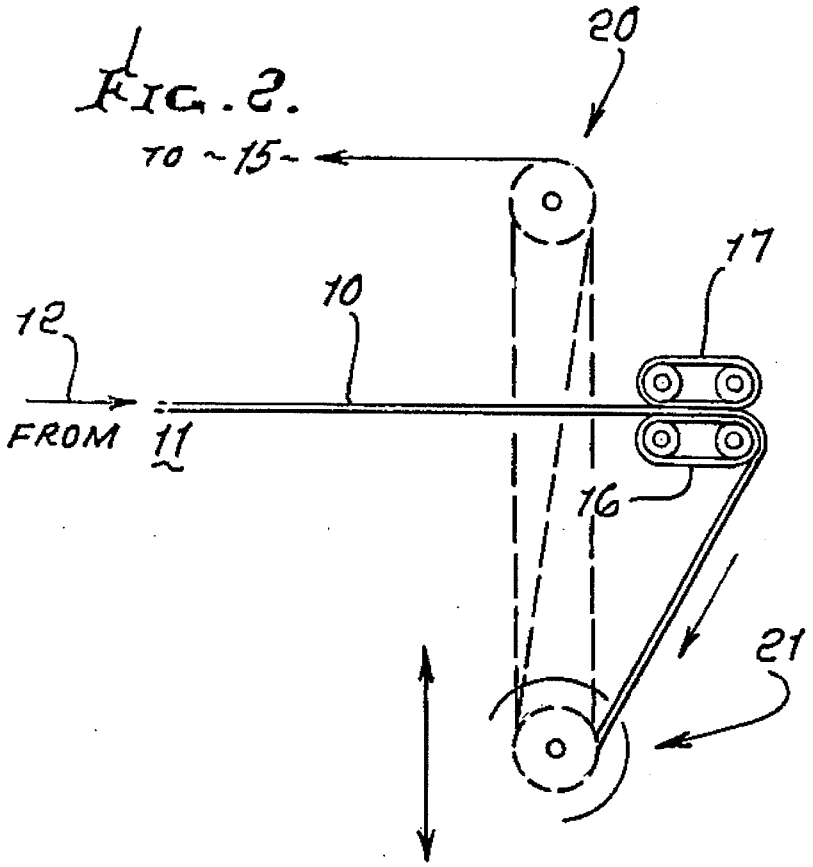
FIG. 2 is a schematic diagram.
Figure 3:
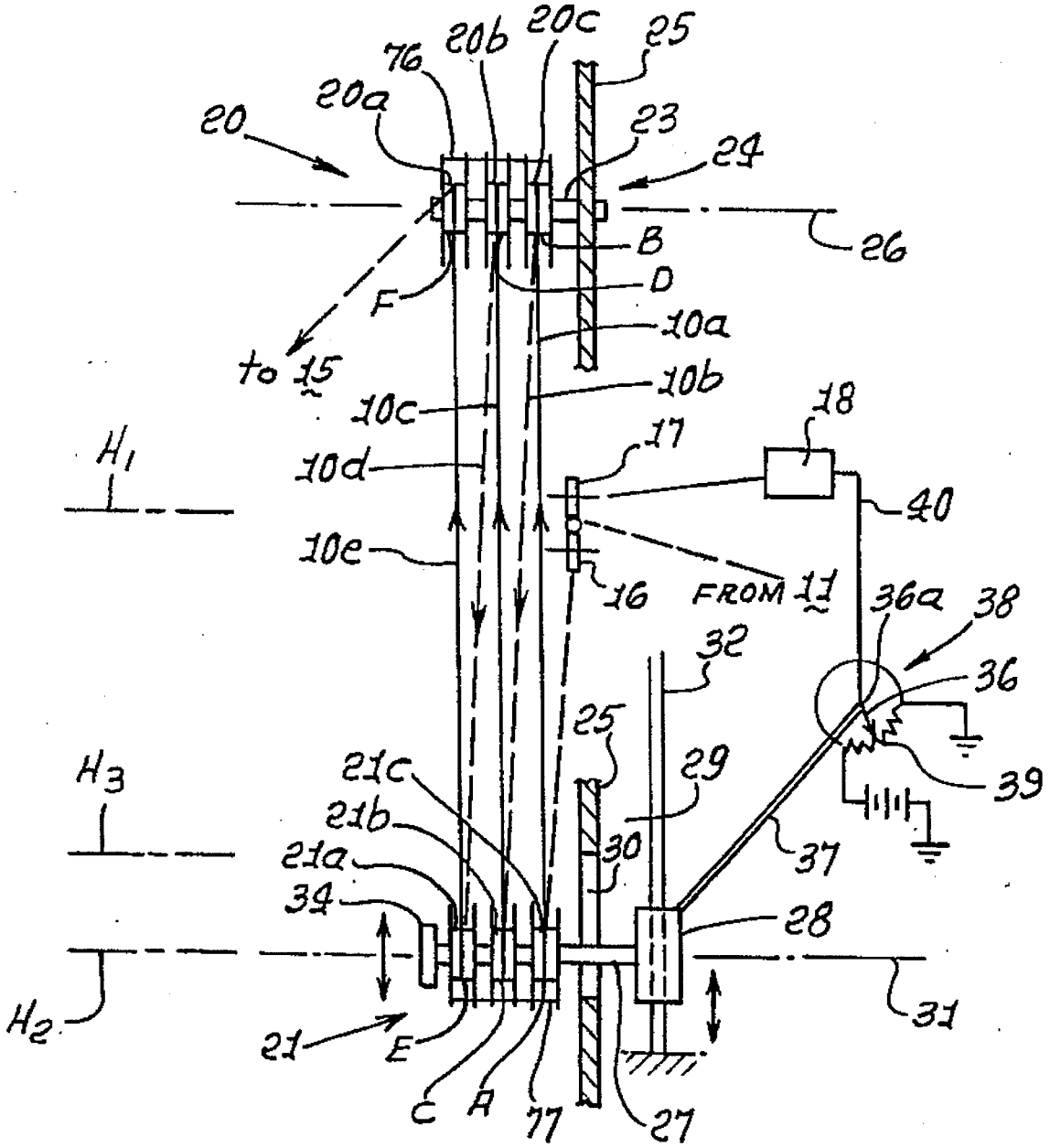
FIG. 3 is a schematic diagram.

In FIGS. 1–3, wire or cable 10 is being de-reeled from a storage reel 11, in direction 12. The wire is passed to the means 13 described herein, via the wire drive 14 for advancement to the wire processing means 15 (wire cutter or insulation stripper, etc.). Drive 14 includes belt means including lower drive belt 16, and upper drive belt 17. The belt means may be driven as from a drive indicated at 18. See FIGS. 7–12, to be described. Means 15 typically includes another cable drive for the wire, typically operating intermittently.

In FIGS. 2 and 3, the means 13 may include one or more first elements or pulleys, and one or more second elements or pulleys; and merely for illustration, the pulleys will be described in terms of a first pulley means or a first group of pulleys and a second pulley means or a second group of pulleys, and means mounting the pulleys or groups so that the second is movable relatively toward and away from the first. The first and second groups of pulleys are indicated at 20 and 21. The pulleys 20*a*–20*c* in first group 20 are mounted on a common axle shaft 23, to freely rotate thereon; and shaft 23 is mounted at 24 to the frame 25, to project horizontally. The shaft and pulley axis appears at 26.

Pulleys 21*a*–21*c* in the second group 21 are mounted on a common axle shaft 27 to freely rotate thereon; and shaft 27 is mounted to a follower block 28 located at the inner side 29 of the housing frame. Shaft 27 projects horizontally through a vertical slot 30 in the frame 25, its axis appearing at 31. Block 28 freely slides up and down on a guide rod 32 mounted to frame 25, whereby shaft 27 is maintained horizontal. A weight, as for example a metallic disc 34, is also carried by the shaft 27 at the outer side of the pulleys 21*a*–21*c*, to counteract the upward pull of the wire stretches 10*a*–10*e*, as shown, maintaining balance. In this regard, if feed roller at 15 is demanding (feeding) wire faster than it is being de-reeled, pulleys 21*a*–21*c* are pulled up by the wire entraining them, and vice versa. Such structure may be regarded as one form of lost motion means.

It is possible to employ only one pulley at the location of group 20, and only one pulley at the location of group 21, and the invention contemplates this.

The wire stretches are related to the pulleys between which they extend, as follows:

| wire stretch | between pulleys |
|---|---|
| 10a | 21c and 20c (A & B) |
| 10b | 20c and 21b (B & C) |
| 10c | 21b and 20b (C & D) |
| 10d | 20b and 21a (D & E) |
| 10e | 21a and 20a (E & F) |

Also provided is second means for controlling the speed of the drive means 14 in response to sensing of the movement of the second group of pulleys. That second means typically comprises a sensor to sense the position of the follower block along the rod, and a control operatively connected to the sensor to electrically control the speed of the drive means whereby the speed is decreased in response to lowering the block, and increased in response to raising the block. By way of example, the sensor may comprise a potentiometer 38 wiper 36 pivoted at 36*a* and rotated by an arm 37 connected to follower block 28. As the wiper rotates in contact with resistance 39, correspondingly varied current is supplied at 40 to the motor drive 18 for the drive rollers 16, whereby, as the slider block 28 rises above a selected level between $H_1$ and $H_3$, the current supply to motor 18 is increased to speed wire advancement speed; and as the block 28 drops below a selected level between $H_1$ and $H_3$, that current is decreased to decrease the speed of wire advancement. Accordingly, the de-reeling of wire off the supply reel 11 is smoothened, i.e., sharp acceleration and deceleration are eliminated.

Figure 4:
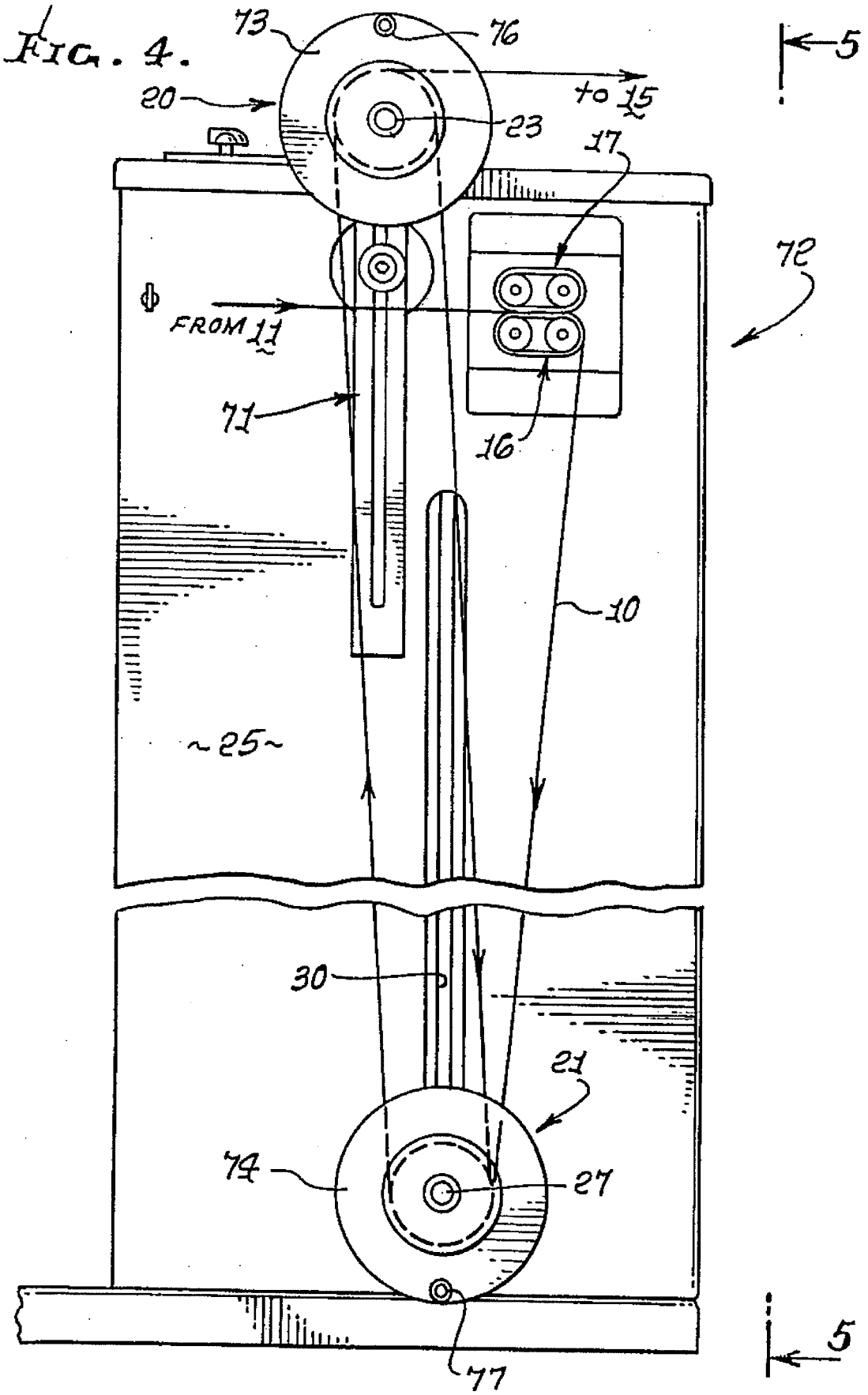
FIG. 4 is a side view like FIG. 2 but showing detailed apparatus, with multiple upper and multiple lower pulleys in groups.
Figure 5:
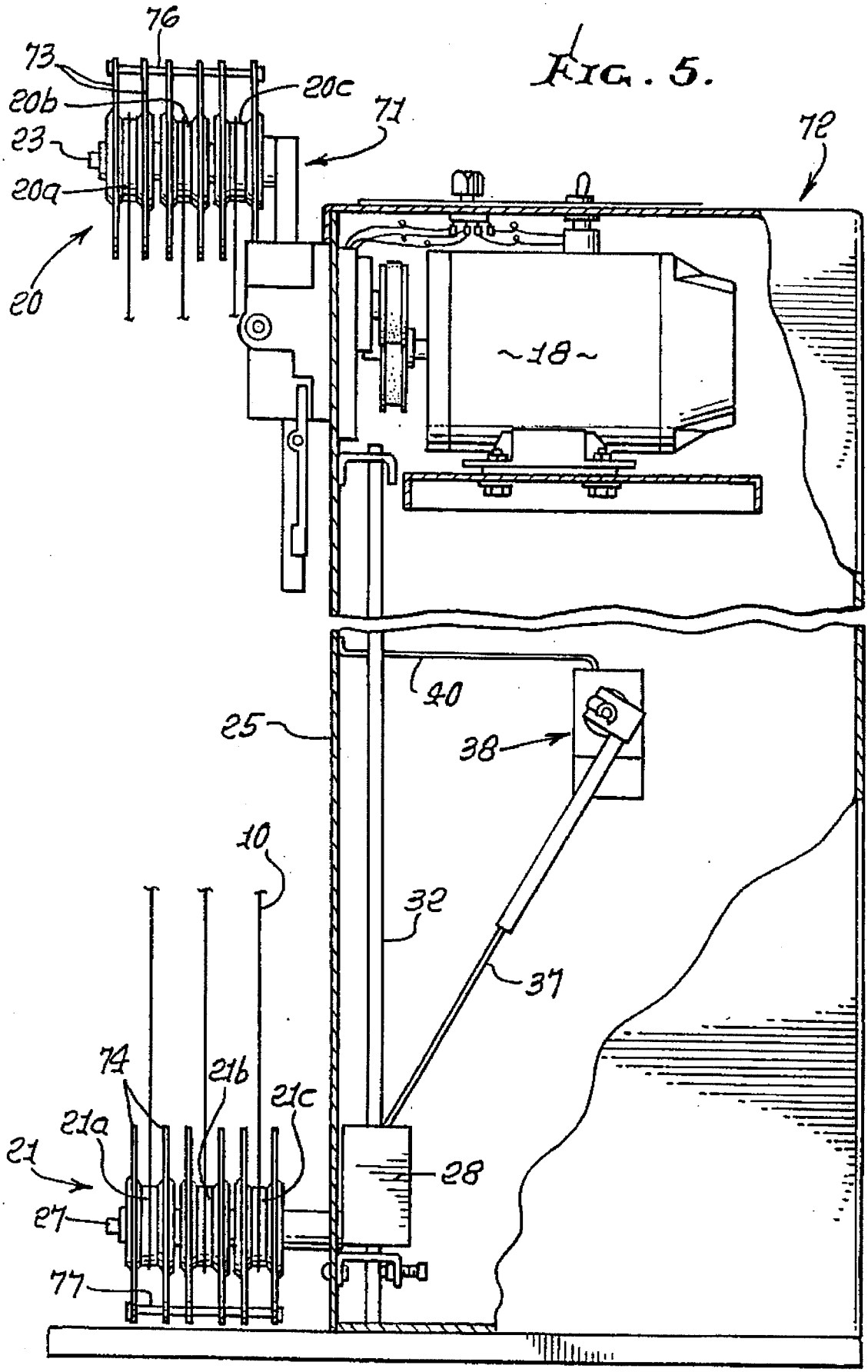
FIG. 5 is a vertical section taken on lines 5—5 of FIG. 4.
Figure 6:
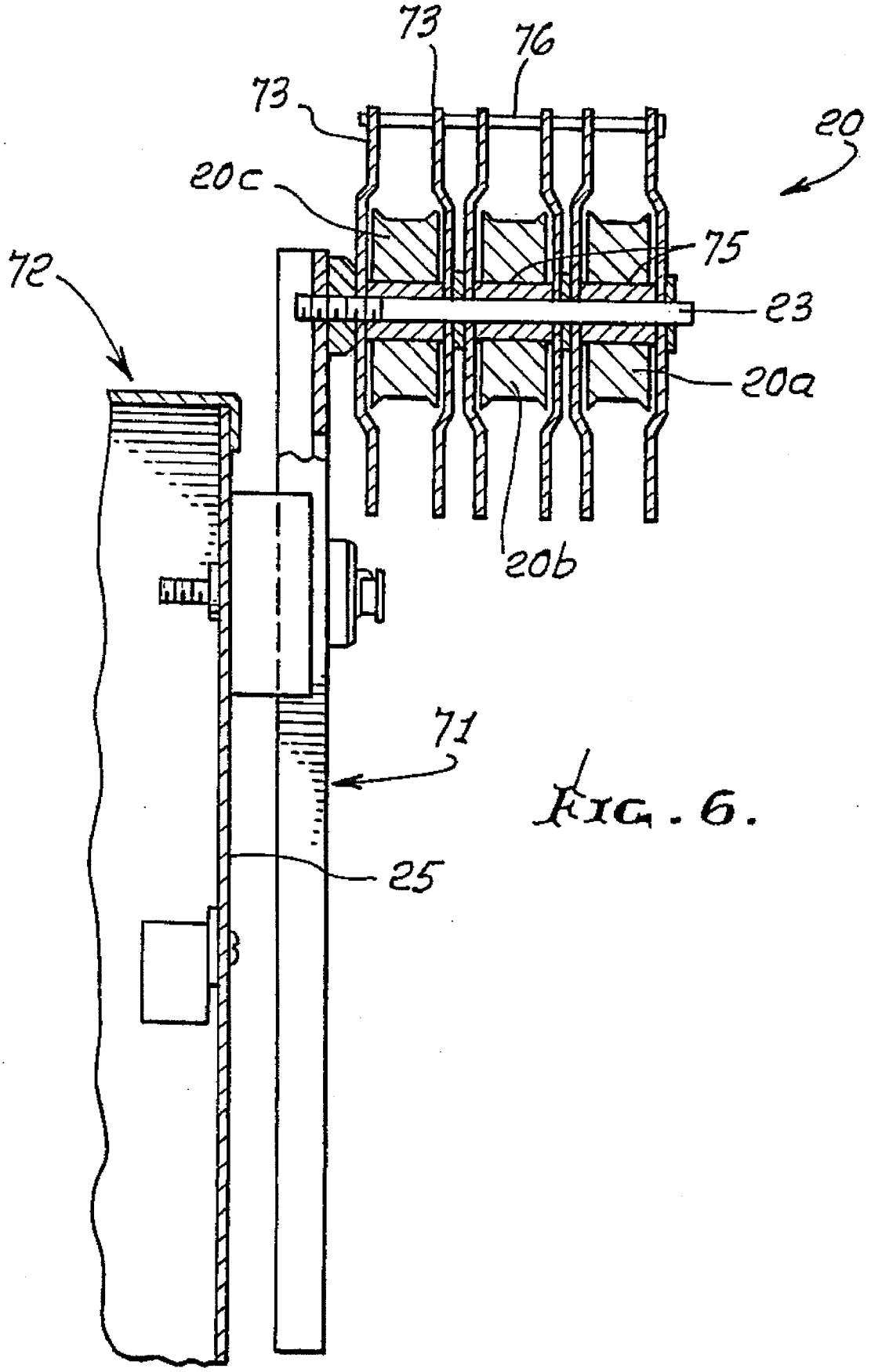
FIG. 6 is an enlarged elevation pulley in section taken through an upper pulley group.
Figure 7:
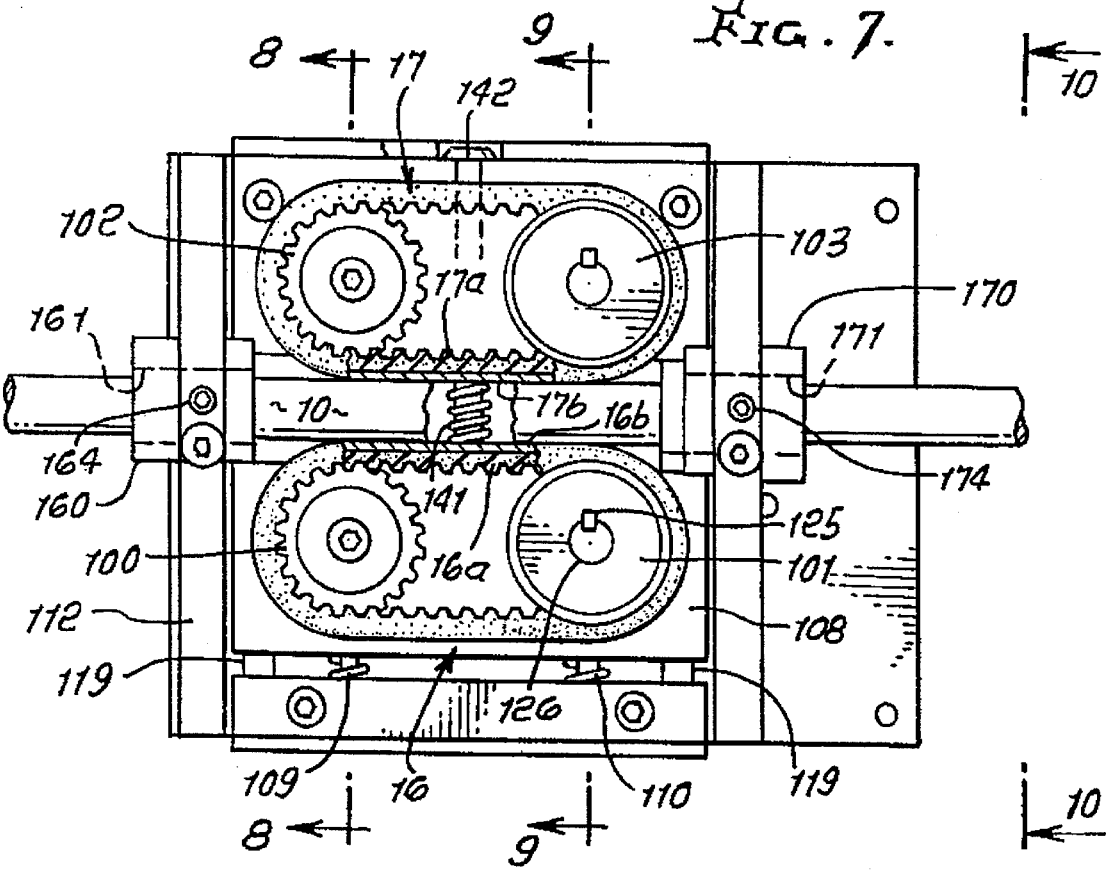
FIG. 7 is a side elevation of wire drive means comprising endless belt loop means.
Figure 8:
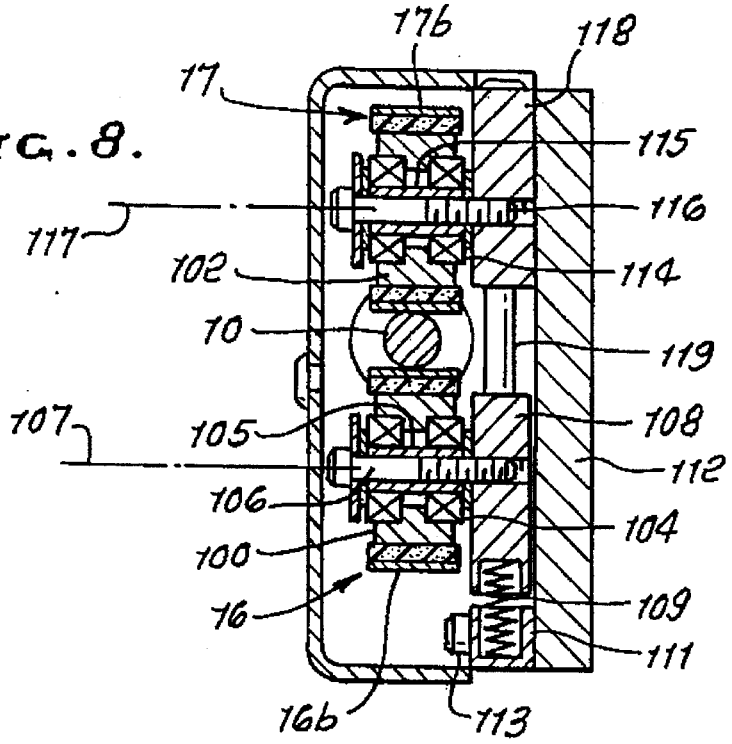
FIG. 8 is a section taken on lines 8—8 of FIG. 7.
Figure 11:
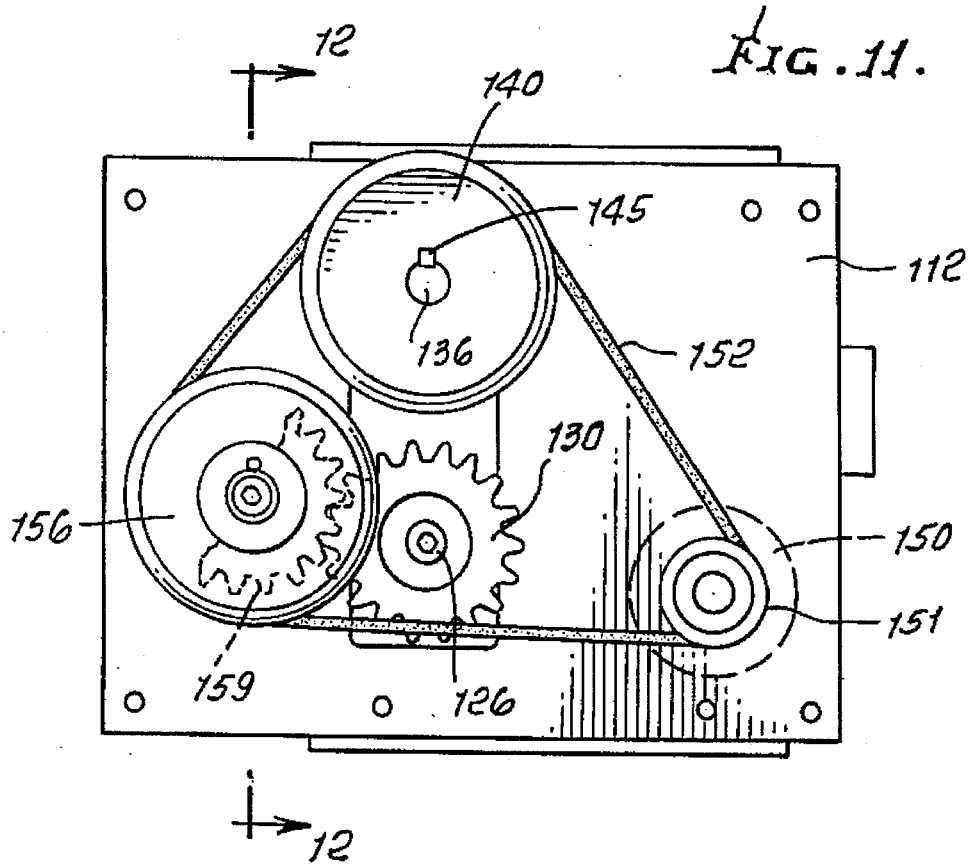
FIG. 11 is a rear side view of the drive means shown on FIG. 7.
Figure 12:
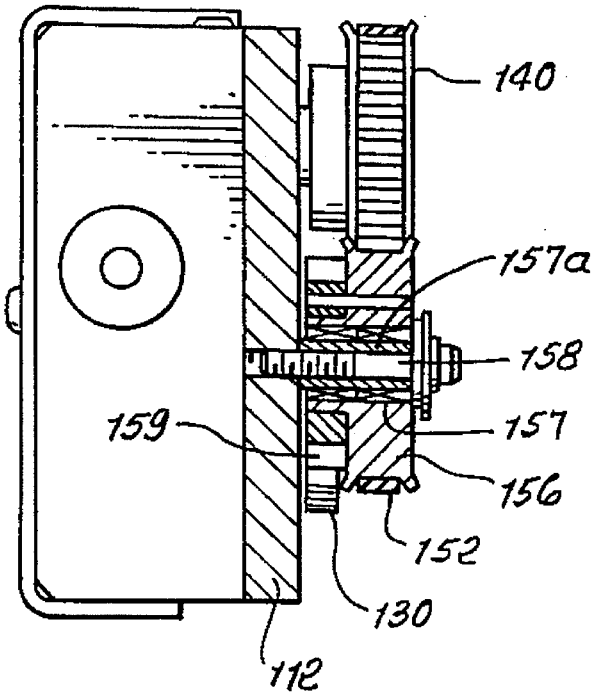
FIG. 12 is a section taken on lines 12—12 of FIG. 11.

FIGS. 4–6 show an actual system, with elements corresponding to those referred to given corresponding numbers. Additional elements include:

| | |
|---|---|
| Idle roller | 70 |
| Height adjustment for roller shaft 23 | 71 |
| Cabinet | 72 |
| Non-rotary guide flanges or sheaves for rollers 20a–20c | 73 |
| Non-rotary guide flanges or sheaves for rollers 21a–21c | 74 |
| Bearings for rollers 20a–20c | 75 |
| Pin to connect sheaves 20a–20c | 76 |
| Pin to connect sheaves 21a–21c (pins 76 and 77 also prevent wire from coming off the rollers at 20 and 21) | 77 |

Referring now to FIGS. 7–12, the lower and upper looping belts 16 and 17 typically comprise timing belts, with teeth as shown, and having elongated stretches 16*a* and 17*a* to compressively engage the wire or cable 10. The belts may consist of elastomeric material, such as Neoprene; and they, preferably, have layers of polyurethane bonded to their wire engaging surfaces. See such layers 16*b* and 17*b* in FIG. 8. Lower toothed hubs 100 and 101 (otherwise referred to as A and B hubs) entrain the teeth of belt 16; and upper toothed hubs 102 and 103 (otherwise referred to as C and D hubs) entrain the teeth of belt 17. Bearings 104 support lower idler hub 100 to rotate on a sleeve 105 carried by lateral shaft 106. The shaft and hub axis appears at 107, and the shaft is carried by a lower block member 108, urged upwardly by compression springs 109 and 110. See also in FIG. 8 the spring lower end receptacle block 111 attached to frame 112 at 113. An upper spring 141 bears downwardly on block 108, and its tension is adjustable by rotating a screw 142 bearing against 141. Screw 142 is carried by frame 112. The compression of the belts against the wire is then made adjustable.

Bearings 114 support upper idler hub 102 to rotate on a sleeve 115 carried by shaft 116. The axis of shaft 116 and of hub 102 appears at 117; and the shaft 116 is carried by an upper block member 118 fixed to frame 112. Parallel belt stretches 16*a* and 17*a* are drivingly engageable with the wire, lengthwise thereof, when lower block member 108 is urged upwardly toward member 118 by the springs 109 and 110. See also vertical guide rods 119 on which block member 108 slides. Use of parallel belt stretches 16*a* and 17*a* facilitates or enables use of only one pulley at 20 and only one pulley at 21.

The lower and upper hubs 101 and 103 are belt loop driving hubs, and drive means is connected therewith to accomplish synchronized driving so that the wire or cable engaging stretches 16*a* and 17*a* frictionally and compressively engaging opposite sides of the wire or cable travel at exactly the same rate. Such drive means is typically reversible, for de-reeling the wire, or for driving the wire reversely back toward the reel and will be referred to.

FIG. 9 shows lower hub 101 keyed at 125 to a shaft 126 projecting horizontally, and defining an axis 127, parallel to axis 107 and 117. Shaft 126 is bearing mounted and supported at 128 by carrier 129, supported by lower block member 108. Accordingly, hub 101 moves up and down with hub 100. A driven sprocket 130 is keyed to shaft 126, and has teeth 130*a*, at the outer or opposite side of frame 112. Upper hub 103 is keyed at 135 to a shaft 136 projecting horizontally laterally, and defines an axis 137 parallel to 127, 117 and 107. Shaft 136 is bearing mounted and supported at 138 by a carrier 139 affixed to frame 112. A driven pulley 140 is keyed at 154 to shaft 136.

A motor 150 has a drive pulley 151 driving pulley 140 and also a second pulley 156 by means of timing belt 152. The latter is rotatable on a bearing 157 and sleeve 157*a* surrounding a mounting shaft 158 carried by frame 112. See FIG. 12. A sprocket 159 is affixed to pulley 156 to rotate about shaft 158, and it meshes with sprocket 130 previously referred to. Thus, shafts 136 and 126 are driven in opposite directions, as are the hubs 101 and 103 that drive the belt loops. Additionally, the meshing of the two sprockets is such as to accommodate up and down movement of the hubs 100 and 101 relative to hubs 102 and 103, while maintaining the drive hub 101 and 103 driven relationship, as referred to.

Wire guide means is also provided to accommodate wire of different diameters, yet also operative to guide the wire or cable between the belt stretches 16*a* and 17*a*. See the first guide 160 in FIGS. 7 and 8 and having a wire guiding bore 161 slightly larger than the wire 10 diameter. That bore also serves a wire guiding function for wire of smaller diameters, i.e., it effectively feeds or directs the wire toward the converging portion of the belt loops as they converge toward the straight stretches 16*a* and 17*a*. A fastener 164 attaches the guide to the frame 112, enabling removal of the guide for replacement. A second guide is shown at 170, with a bore 171 to pass the wire or cable that has passed beyond the belt loops 16 and 17, and it too is removably attached at 174 to the frame.

In the above, a pulley may be considered as one form of an endless element.

We claim:

1. In a wire feeding system, for use with apparatus that processes the wire in conjunction with intermittent advancement of the wire, said feeding system operating to de-reel the wire from a reel and to supply the de-reeled wire to said apparatus, said system comprising in combination:

a) a first endless element and a second endless element, and means mounting said elements so that the second element is movable relatively toward and away from the first element, b) first means for urging one of said elements relatively away from the other of said elements, c) wire drive means to positively advance the wire to travel to said apparatus, d) and second means for controlling the speed of said drive means in response to sensing the position of said second element, e) there being means positioning said wire drive means to feed wire to the second element, and whereby wire successively passes between and entrains said elements, in passing from said reel to said apparatus, and whereby the wire is maintained taut as said second element moves toward and away from said first element, f) said first endless element being a first group of at least two pulleys, and said second endless element being a second group of at least two pulleys.

2. The combination of claim 1 including a follower block mounting the second element, and an upright guide rod along which the follower block is guidedly movable.

3. The combination of claim 2 wherein said second means comprises a sensor to sense the position of the follower block along said rod, and a control operatively connected to said sensor to electrically control the speed of said drive means whereby said speed is decreased in response to the moving of said block in one direction, and increased in response to the moving of said block in the opposite direction.

4. The combination of claim 1 including a guide and a follower means carrying said second element, said follower means adapted to be slidable along on said guide.

5. The combination of claim 4 including a controller responsive to the position of said follower means on said guide to control the speed of wire advancement such that said speed is increased, as said follower means rises on said guide, and said speed is reduced as said follower means lowers on said guide.

6. The combination of claim 5 wherein said second element has one axial side and an opposite axial side, and including a weight at said one axial side of said second element, and said follower means is at said opposite axial side of said second element.

7. The combination of claim 1 including non-rotary guide flanges at opposite sides of the pulleys in each group.

8. The combination of claim 1 including wire guide flanges at opposite axial sides of each pulley in each group.

9. The combination of claim 8 including retainer means carried by the flanges and extending therebetween to block wire de-trainment off the pulleys.

10. The combination of claim 1 wherein the pulleys in the first group are A, C and E pulleys, and the pulleys in the second group are B, D and F pulleys, and the wire entrains said pulleys in the sequence A-B-C-D-E-F.

11. The combination of claim 1 wherein the second group of pulleys is below the level of said first group of pulleys, and said first means comprises a weight.

12. The combination of claim 1 wherein said pulleys in each group are substantially coaxial and of the same radius.

13. The combination of claim 1 wherein there are only three pulleys in each group.

14. The combination of claim 1 wherein said wire drive means is positioned to feed wire to one of said pulley groups.

15. The combination of claim 1 wherein the wire drive means is positioned to feed wire to a pulley in the second group.

* * * * *